US012201194B2

(12) United States Patent
Shah

(10) Patent No.: US 12,201,194 B2
(45) Date of Patent: Jan. 21, 2025

(54) METAL ONE PIECE SLIDE AND PULL FOR SLIDE FASTENER

(71) Applicant: SHAH TECHNOLOGIES LLC, Palm Beach Gardens, FL (US)

(72) Inventor: Nirav Ashok Shah, Mumbai (IN)

(73) Assignee: SHAH TECHNOLOGIES LLC, Palm Beach Gardens, FL (US)

( * ) Notice: Subject to any disclaimer, the term of this patent is extended or adjusted under 35 U.S.C. 154(b) by 0 days.

(21) Appl. No.: 18/309,797

(22) Filed: Apr. 29, 2023

(65) Prior Publication Data

US 2023/0263273 A1 Aug. 24, 2023

Related U.S. Application Data

(63) Continuation of application No. 17/823,289, filed on Aug. 30, 2022, now abandoned, which is a continuation of application No. 17/320,421, filed on May 14, 2021, now Pat. No. 11,432,621, which is a continuation-in-part of application No. 16/119,508, filed on Aug. 31, 2018, now Pat. No. 11,006,703, said application No. 15/385,294 is a continuation-in-part of application No. 15/385,000, filed on Dec. 20, 2016, now Pat. No. 10,064,455, said application No. 16/119,508 is a continuation-in-part of application (Continued)

(30) Foreign Application Priority Data

Apr. 1, 2016 (IN) ..... 201621011697

(51) Int. Cl.
*A44B 19/30* (2006.01)

(52) U.S. Cl.
CPC ..... *A44B 19/30* (2013.01)

(58) Field of Classification Search
CPC ..... A44B 19/30; A44B 19/26; A44B 19/262
See application file for complete search history.

(56) References Cited

U.S. PATENT DOCUMENTS 2,229,216 A * 1/1941 Marinsky ..... A44B 19/26 24/382
2,274,161 A 2/1942 Poux
2,509,278 A 5/1950 Scheuermann et al.

(Continued)

FOREIGN PATENT DOCUMENTS

CA 3019584 10/2017
CN 2167578 6/1994

(Continued)

OTHER PUBLICATIONS

Anonymous, "How die casting machine produce zipper slider", King Machine Tech Co., Ltd. Internet article retrieved Jun. 14, 2016, http://www.kinghuamc.com/how-die-casting-machine-produce-zipper-slide/, (2016).

*Primary Examiner* — David M Upchurch
(74) *Attorney, Agent, or Firm* — McHale & Slavin, P.A.

(57) ABSTRACT

The invention involves a slide assembly for a zipper, and a method for manufacturing a zipper slide assembly. The slider assembly is formed in a single die cast operation to include the slider and the pull member being formed simultaneously. At least one side shifting slide is incorporated into the die, which allows the bridge and pull loop to be formed with their full geometric shape and without the converging flat surfaces required in the prior art.

12 Claims, 7 Drawing Sheets

Related U.S. Application Data

No. 15/385,294, filed on Dec. 20, 2016, now Pat. No. 10,064,457.

(56) References Cited

U.S. PATENT DOCUMENTS

| | | | | |
|---|---|---|---|---|
| 2,705,345 | A | 4/1955 | Epple | |
| 2,736,062 | A | 2/1956 | Scheuermann et al. | |
| 3,018,534 | A | 1/1962 | Huelster | |
| 3,129,480 | A | 4/1964 | Carlile | |
| 3,225,405 | A | 12/1965 | Moser | |
| 3,320,645 | A | 5/1967 | Burbank | |
| 3,419,943 | A | 1/1969 | Heimberger | |
| 3,793,684 | A | 2/1974 | Moertel | |
| 4,081,883 | A | 4/1978 | Ishii et al. | |
| 4,102,022 | A | 7/1978 | Aoki | |
| 4,123,828 | A | 11/1978 | Akashi | |
| 4,210,196 | A | 7/1980 | Weiner | |
| 4,287,646 | A | 9/1981 | Kanzaka | |
| 4,389,758 | A | 6/1983 | Akashi | |
| 4,578,966 | A * | 4/1986 | Kasai | A44B 19/301 24/418 |
| 4,644,613 | A | 2/1987 | Kedzierski | |
| 4,679,281 | A | 7/1987 | Ishii et al. | |
| 4,719,673 | A | 1/1988 | Kubo | |
| 4,768,263 | A | 9/1988 | Fukuroi et al. | |
| 4,790,973 | A | 12/1988 | Minami et al. | |
| 4,976,014 | A | 12/1990 | Akashi et al. | |
| 4,985,969 | A | 1/1991 | Terada et al. | |
| 5,013,511 | A | 5/1991 | Akashi | |
| 5,073,103 | A | 12/1991 | Liao | |
| 5,101,538 | A | 4/1992 | Dieter | |
| 5,152,036 | A | 10/1992 | Oda et al. | |
| 5,419,019 | A | 5/1995 | Ida | |
| 5,544,394 | A | 8/1996 | Yaguramaki | |
| 5,604,962 | A | 2/1997 | Mayerhofer | |
| 5,611,121 | A | 3/1997 | Akeno | |
| 5,621,954 | A | 4/1997 | Mizuno | |
| 5,625,928 | A | 5/1997 | Terada et al. | |
| 5,664,300 | A | 9/1997 | Mizuno | |
| 5,694,667 | A | 12/1997 | Mizuno | |
| 5,698,243 | A | 12/1997 | Wakabayashi | |
| 5,729,874 | A | 3/1998 | Mizuno | |
| 5,809,622 | A | 9/1998 | Yaguramaki | |
| 5,884,373 | A | 3/1999 | Kawanura | |
| 5,896,628 | A | 4/1999 | Oda | |
| 5,915,632 | A | 6/1999 | Muratsubaki et al. | |
| 5,956,819 | A | 9/1999 | Tarasaki et al. | |
| 5,991,981 | A | 11/1999 | Komuro et al. | |
| 6,062,839 | A | 5/2000 | Funaya | |
| 6,094,786 | A | 8/2000 | Wakabayashi | |
| 7,320,768 | B2 | 1/2008 | Eimura | |
| 9,629,423 | B2 * | 4/2017 | Schlipper | A44B 19/262 |
| 2002/0050030 | A1 | 5/2002 | Takasawa | |
| 2003/0079317 | A1 | 5/2003 | Oda | |
| 2003/0079318 | A1 | 5/2003 | Oda | |
| 2003/0177616 | A1 | 9/2003 | Petrovic et al. | |
| 2003/0192151 | A1 | 10/2003 | Metzger | |
| 2004/0034974 | A1 | 2/2004 | Arai et al. | |
| 2005/0086775 | A1 | 4/2005 | Bernasconi | |
| 2005/0097712 | A1 | 5/2005 | Raynor | |
| 2005/0204516 | A1 * | 9/2005 | Leva | A44B 19/26 24/385 |
| 2007/0022579 | A1 * | 2/2007 | Akashi | A44B 19/301 24/386 |
| 2007/0033776 | A1 | 2/2007 | Yoneoka | |
| 2007/0186392 | A1 | 8/2007 | Sewitch. Jr. | |
| 2008/0229554 | A1 * | 9/2008 | Payne | A44B 19/30 24/418 |
| 2009/0106951 | A1 * | 4/2009 | Edwards | A44B 19/301 24/399 |
| 2009/0229091 | A1 | 9/2009 | Peano | |
| 2010/0269311 | A1 | 10/2010 | Jacobsen | |
| 2012/0023714 | A1 * | 2/2012 | King | A45C 13/18 24/415 |
| 2012/0260469 | A1 | 10/2012 | Yamamoto et al. | |
| 2013/0007994 | A1 | 1/2013 | Iannello et al. | |
| 2013/0174386 | A1 | 7/2013 | Koenigkramer | |
| 2013/0255042 | A1 | 10/2013 | Keyaki et al. | |
| 2013/0291350 | A1 | 11/2013 | Cowin et al. | |
| 2013/0312230 | A1 | 11/2013 | Chang et al. | |
| 2014/0082896 | A1 | 3/2014 | Li et al. | |
| 2015/0113771 | A1 | 4/2015 | Keyaki et al. | |
| 2015/0201716 | A1 | 7/2015 | Septien Rojas et al. | |
| 2015/0203251 | A1 | 7/2015 | Anzini et al. | |
| 2015/0335107 | A1 * | 11/2015 | Hamada | A44B 19/262 24/429 |
| 2017/0318914 | A1 | 11/2017 | Shah | |

FOREIGN PATENT DOCUMENTS

| | | |
|---|---|---|
| CN | 1338370 | 3/2002 |
| CN | 1105629 | 4/2003 |
| DE | 1904024 | 8/1970 |
| EP | 0282987 | 9/1988 |
| FR | 2951915 | 5/2011 |
| GB | 2220608 | 1/1990 |
| GB | 2289917 | 12/1995 |
| JP | IPH02243103 | 9/1990 |

* cited by examiner

METAL ONE PIECE SLIDE AND PULL FOR SLIDE FASTENER

PRIORITY CLAIM

In accordance with 37 C.F.R. 1.76, a claim of priority is included in an Application Data Sheet filed concurrently herewith. Accordingly, the present invention claims the benefit of the priority as a continuation of U.S. patent application Ser. No. 17/823,289, entitled "Metal One Piece Slide and Pull for Slide Fastener", filed Aug. 30, 2022; which claims priority as a continuation of U.S. patent application Ser. No. 17/320,421, entitled "Metal One Piece Slide and Pull for Slide Fastener", filed May 14, 2021, now U.S. Pat. No. 11,432,621, issued on Sep. 6, 2022; which claims priority as a continuation-in-part of U.S. patent application Ser. No. 16/119,508, entitled "Metal One Piece Slide and Pull for Slide Fastener", filed Aug. 31, 2018, now U.S. Pat. No. 11,006,703, issued on May 18, 2021, which claims priority as a continuation-in-part of U.S. patent application Ser. No. 15/385,294, entitled "Metal One Piece Locking Slide and Pull for Slide Fastener", filed Dec. 20, 2016, now U.S. Pat. No. 10,064,457, issued on Sep. 4, 2018, which claims priority as a continuation-in-part of U.S. patent application Ser. No. 15/385,000, entitled "Metal One Piece Slide and Pull For Slide Fastener", filed Dec. 20, 2016, now U.S. Pat. No. 10,064,455, issued on Sep. 4, 2018, which claims the benefit of the priority of Indian Provisional patent application No. 20/162,1011697, entitled "A Single Piece Slider and All Types of Manufacturing Process to Make a Single Piece Slider Thereof", filed Apr. 1, 2016; the contents of which are incorporated herein by reference.

FIELD OF INVENTION

The present invention generally relates to slide fasteners, commonly referred to as zippers, and more particularly to a one piece slider and pull made from metal for the slide fastener.

BACKGROUND INFORMATION

A zipper, zip, fly or zip fastener, formerly known as a clasp locker or slide fastener, is a commonly used device for binding the edges of an opening of fabric or other flexible material, like on a garment or a bag. It is used in clothing (e.g., jackets and jeans), luggage and other bags, sporting goods, camping gear, and other items.

The bulk of a zipper/zip consists of two rows of protruding teeth, which may be made to interdigitate, linking the rows, carrying from tens to hundreds of specially shaped metal or plastic teeth. These teeth can be either individual or shaped from a continuous coil, and are also referred to as elements. The slider operated by hand, moves along the rows of teeth. Inside the slider is a Y-shaped channel that meshes together or separates the opposing rows of teeth, depending on the direction of the slider's movement.

In general, a zipper represents a small amount of the overall cost of a product. However, if it fails, the entire garment or device may be unusable until the zipper is replaced or repaired. Problems often lie with the slider portion of the zipper. Sliders are typically made of a slide portion and a pull. The user grabs the pull, which is pivotally connected to the slide, and pushes or pulls the slide in one direction or the other to cause the slide to move. Movement of the slide causes the teeth to engage or disengage with each other as the movement occurs. Slides are typically manufactured to include one or more pieces to which the pull is later assembled. Assembly of the pull to the slide is usually accomplished by bending a bridge portion of the slide, which is die cast having a gap to create an interlocking engagement between the two components. Other methods require assembly of extra bridge components which may be bent, staked or otherwise secured to the slide. However, these constructions are weak and prone to breakage with repeated use, causing the pull to become separated from the slide.

It has been proposed in the past to form the slide and the pull in a single operation. However, the proposed methods, devices and resulting zipper products have been unable to be produced or are unacceptable to the industry when produced from metal. Producing a metal slider assembly with the pull interlocked with the bridge has proven to be extremely difficult due to the rigid properties of the metal, which makes tool retraction from around the formed part very difficult without modifying the geometry of the part in an undesirable manner.

For example, U.S. Pat. No. 2,736,062 to Scheuermann et al. discloses a method of molding a slide and pull together in a single operation. Scheuermann utilizes four slides that intersect at 45 degree angles with respect to each other. The slides intersect at the bridge and pull portions of the slider assembly with the pull positioned at a vertical right angle with respect to the top surface of the slide. However, this method, as shown in the drawings, requires the inner surfaces of the pull loop and the bridge to include 45 degree or similar angles that form sharp points along the inner surfaces. The sharp points cause stress risers in the part, and the sharp corners wear very quickly, causing any surface coatings to be worn away. This results in discoloration of the slide assembly and often results in corrosion of the parts during a washing cycle. In addition, the modified geometry severely limits the movement of the pull within the bridge by reducing the space that the pull has to rotate and slide within the bridge.

U.S. Pat. No. 5,604,962 to Mayerhofer, U.S. Pat. No. 5,698,243 to Wakabayashi, U.S. Pat. No. 4,210,196 to Weiner, and U.K. Patent No 2,220,608 to Liso all show variations of the Scheuermann device, which all require the angles inside of the bridge and the pull to retract the tools. Even though the angles are not depicted in all of the patents, the tooling cannot be retracted through hardened metal, and thus must be there for the tooling to function.

U.S. Pat. No. 2,509,278 to Scheuermann discloses a mold that rotates the pull about its vertical axis to try and eliminate the angles on the inner surface of the pull loop. However, the angles are still required on the inner surface of the bridge, and the difficulty in producing the tools with the precision required for the pull rotation about the vertical axis has proven too costly.

U.S. Pat. No. 4,790,973 to Minami et al. discloses a different method and device for molding slider assemblies. Minami molds the slide first and, once the slide has solidified, a core is partially retracted to form the pull in a secondary molding operation while the slide is still positioned in the mold.

U.S. Pat. No. 5,013,511 to Akashi discloses yet another method and device for forming a zipper slide from metal. Akashi, like Minami, forms the slide portion in a first operation and forms the pull in a secondary operation. However, the pull of Akashi includes a pin which engages the bridge of the slide instead of the loop as disclosed in other prior art.

U.S. Pat. No. 4,985,969 to Terada et al. discloses yet another method and device for forming a zipper slide assembly. Terada forms the pull in combination with an intermediate pull portion with the two portions interlocked with a pin member that is formed within a mold as a secondary operation.

U.K. Patent Application No. 2,289,917 to YKK Corp. discloses a locking slider assembly. The YKK locking slider discloses forming the pull in a separate mold and placing the pull in a secondary mold where the slide is formed around a pin portion of the pull to complete the assembly.

Thus, a need in the art exists for a device and method of forming a slide in combination with a pull, wherein the slide and pull can be formed from metal without the need for modified geometry of the slide assembly, including internal angled surfaces in the bridge and the loop portion of the pull.

The combined slide and pull assembly should satisfy the ergonomic needs that a zipper slide assembly must satisfy in order to achieve acceptance by the end user. This includes providing a slide bridge that includes an internal surface geometry that allows free movement and rotation of the pull. Further, the zipper slide assembly should not require excessive strength to operate or include oversized component parts. Moreover, the zipper slide assembly must assemble together in such a way so as not to detract from the aesthetic appearance of the completed zipper assembly or garment assembly.

Thus, the present invention provides a die cast zipper slide assembly formed in a single operation which overcomes the disadvantages of prior art zipper slide assemblies formed in one or multiple operations. The zipper slide assembly of the present invention not only provides for relative ease in manufacturing, it also permits slides and pulls to be manufactured together without the need to put motion limiting and failure prone angles on the inner surfaces of the bridge and pull loop. The present invention also provides a manufacturing method which utilizes at least one side shifting slide, thereby eliminating the need for slides that interlock at angles and require the part geometry to be modified to accommodate the slide angles.

SUMMARY OF THE INVENTION

Briefly, the invention involves a slider assembly for a zipper and method for manufacturing a zipper slide assembly. The slider assembly is formed in a single die cast operation to include the slider and the pull being formed simultaneously. At least one side shifting slide is incorporated into the die, which allows the bridge and pull loop to be formed with their full geometric shape and without the converging flat surfaces required in the prior art.

Accordingly, it is an objective of the present invention to provide a slider assembly for a zipper that includes a slider and a pull and is formed from metal in one operation.

It is a further objective of the present invention to provide a slider assembly including a slide and a pull that is die cast to include its full geometry without the need for converging inner surfaces as required by the prior art.

It is yet a further objective of the present invention to provide a slider assembly for a zipper that includes a closed puller loop and a closed bridge on the slider.

It is another objective of the present invention to provide a method of manufacturing a slider assembly for a zipper that includes at least one side shifting slide member for shifting the tool around a portion of the formed slide assembly.

It is yet another objective of the present invention to provide a method of manufacturing a slider assembly for a zipper that includes two or more side shifting slides for shifting the slide portions of the tool around solidified part geometry.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENTS

Figure 1:
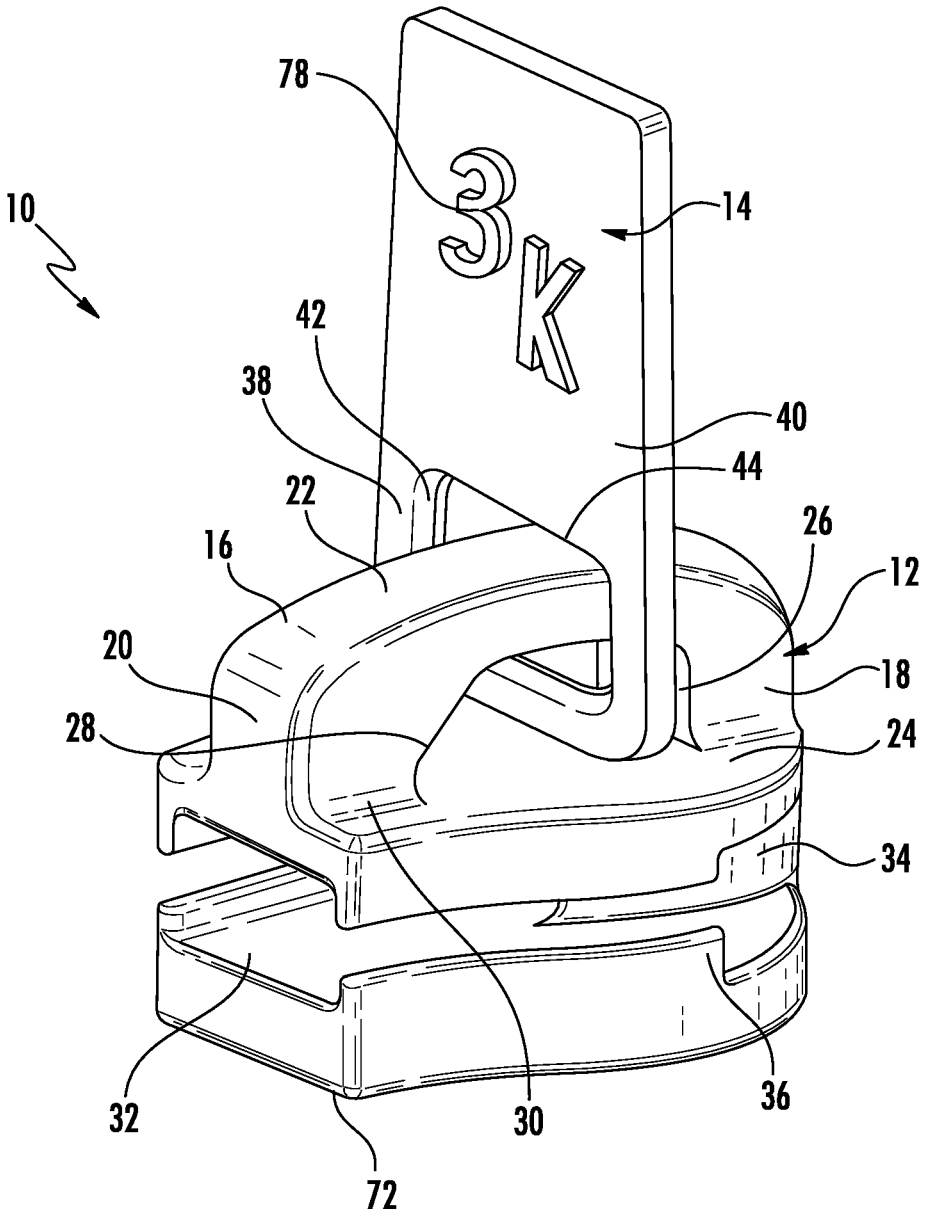
FIG. 1 is a top perspective view of one embodiment of the present invention, illustrating the preferred position for die casting of the slider assembly.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
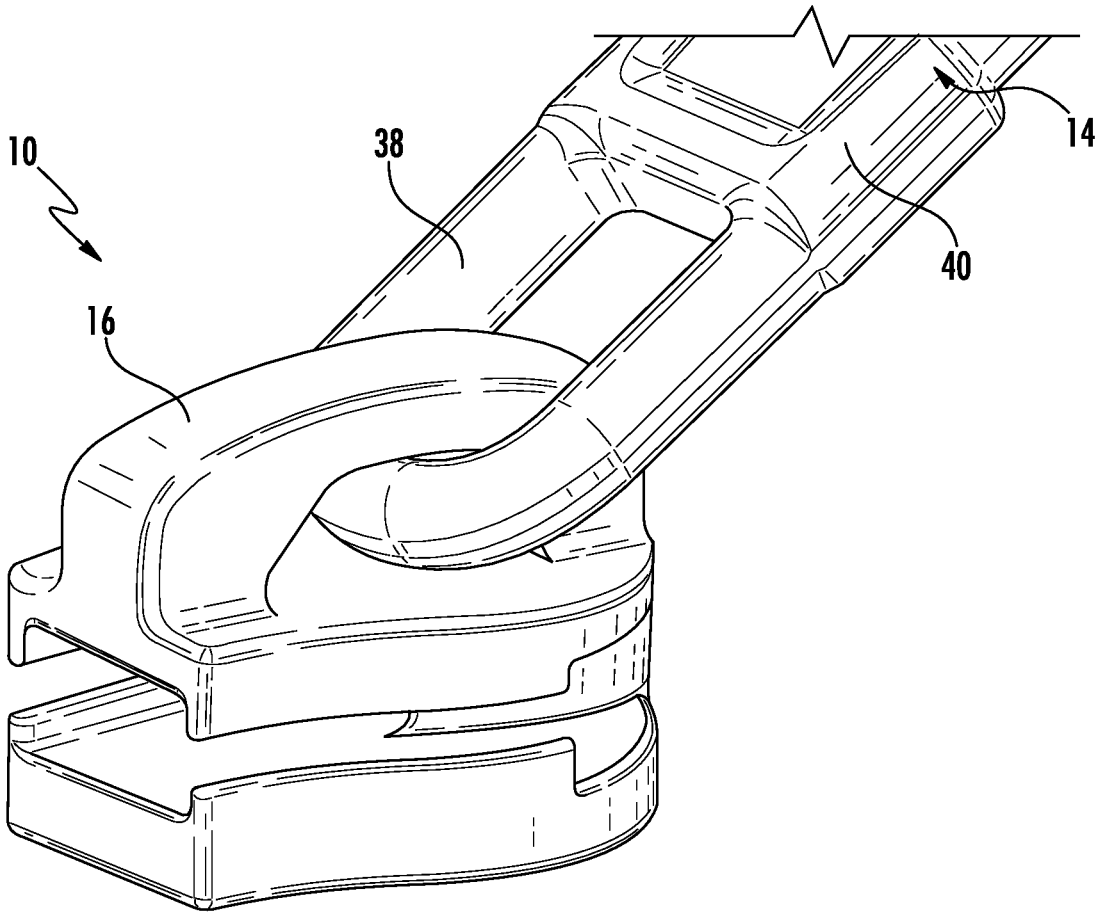
FIG. 2 is a partial top perspective view of the embodiment shown in FIG. 1 illustrating a slider pull that has a round cross section in the area of the bridge.
Figure 3:
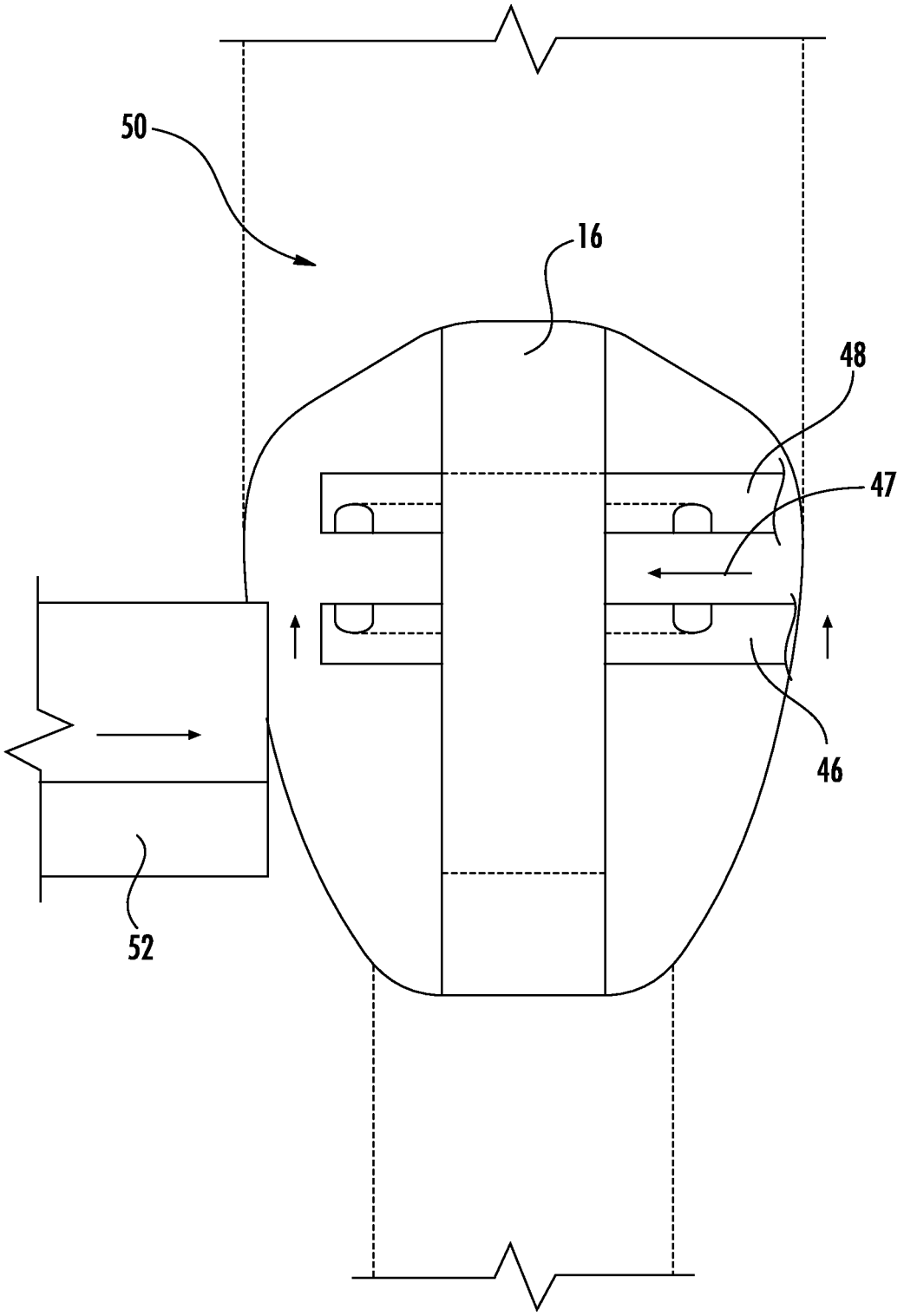
FIG. 3 is a partial top view of the embodiment shown in FIG. 1 illustrating the closing of the die casting tool having at least one side shifting slide.
Figure 4:
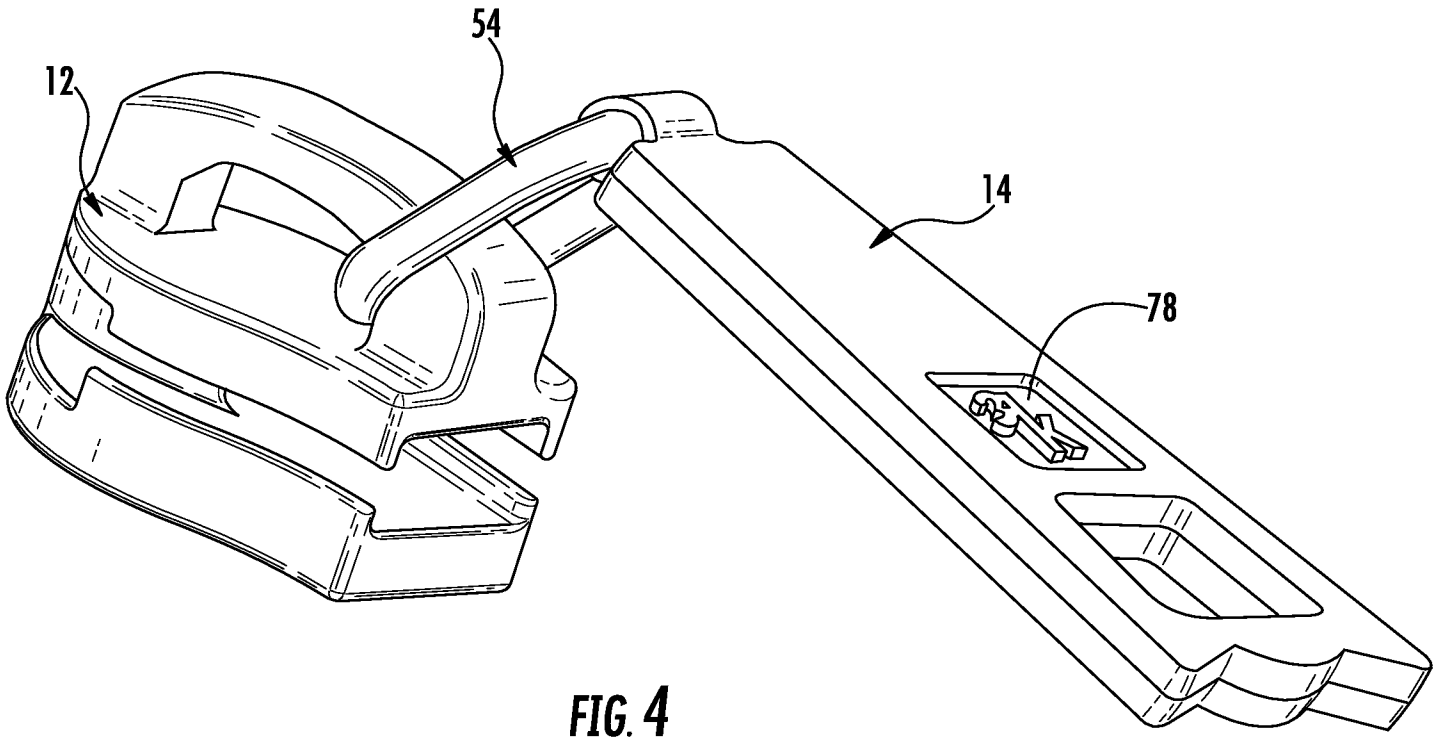
FIG. 4 is a perspective view of an alternative embodiment illustrating an additional link formed between the slide and the pull of the slider assembly.
Figure 5:
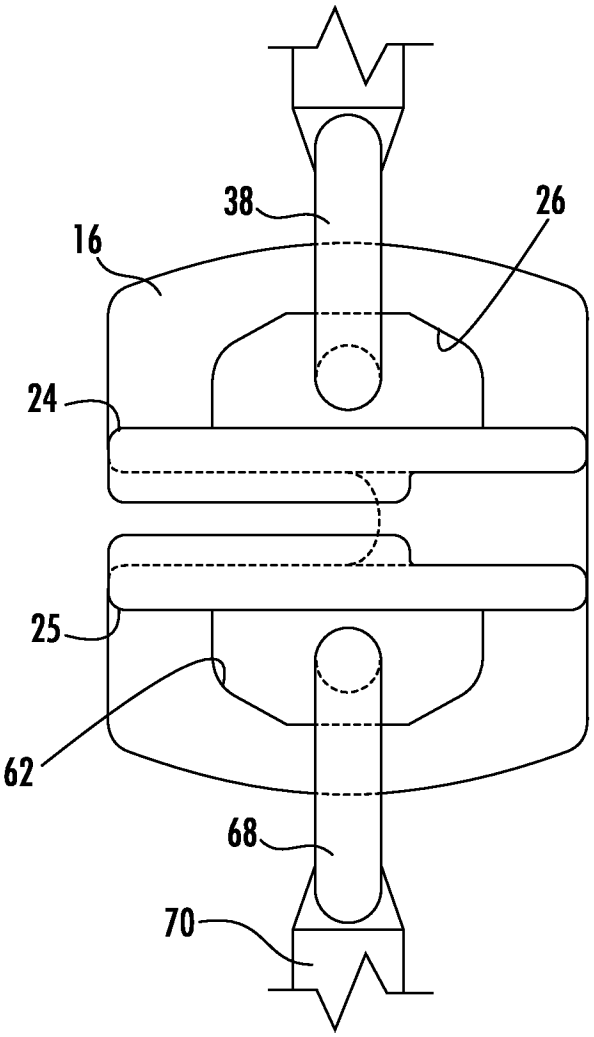
FIG. 5 is a side view illustrating an alternative embodiment having two bridges and two pulls on a single slide.
Figure 6:
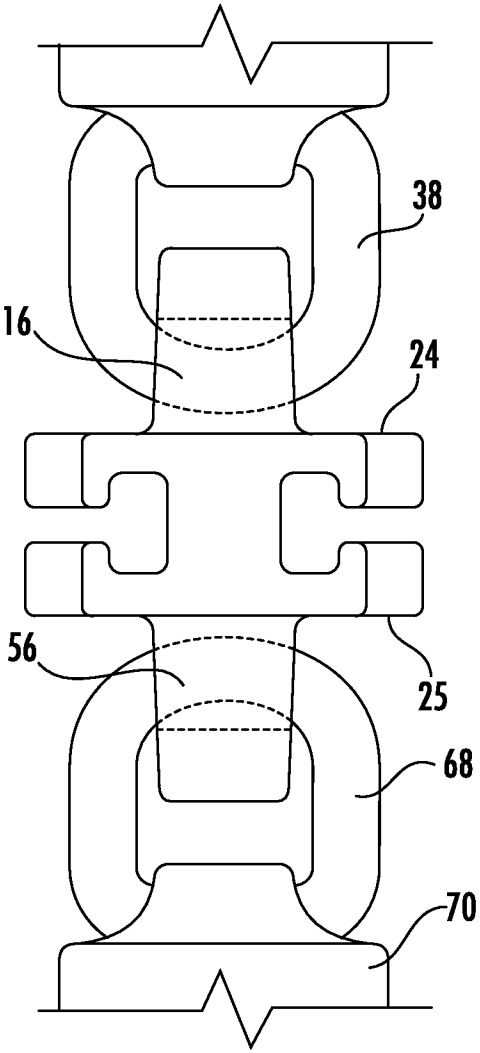
FIG. 6 is an end view illustrating an alternative embodiment having two bridges and two pulls on a single slide.
Figure 7:
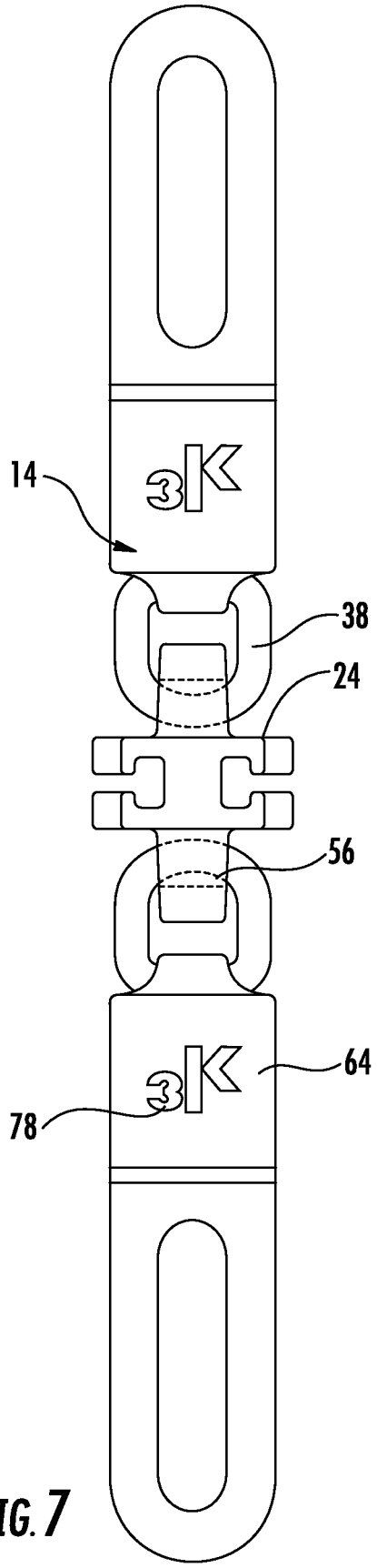
FIG. 7 is an end view illustrating an alternative embodiment having two bridges, two pulls, and two intermediate links on a single slide.
Figure 8:
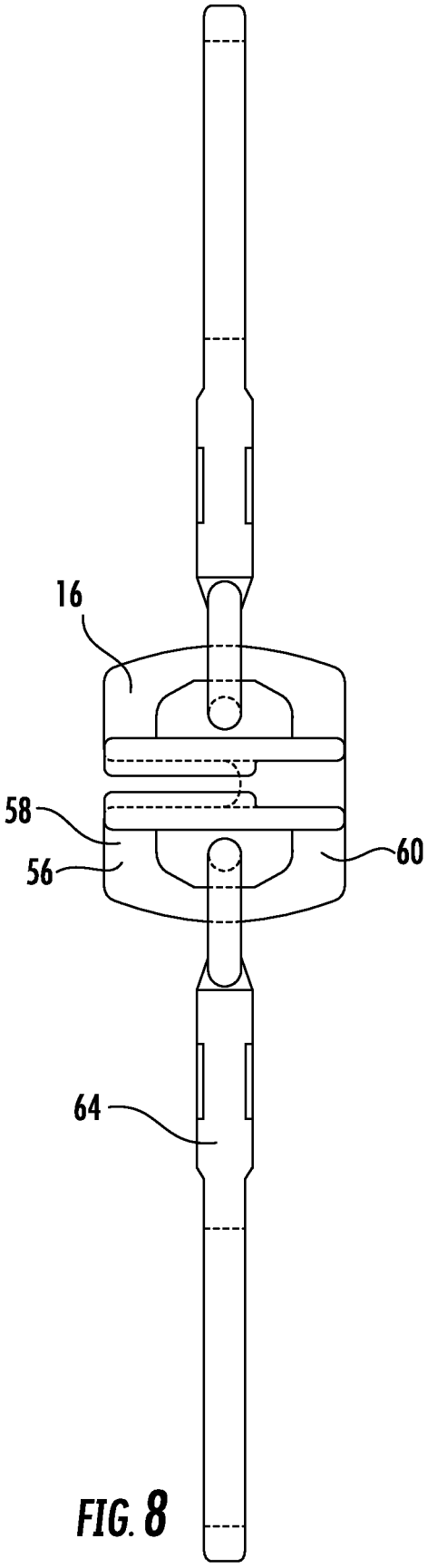
FIG. 8 is a side view illustrating an alternative embodiment having two bridges, two pulls, and two intermediate links on a single slide.

Referring generally to FIGS. 1-3, a slide assembly (10) for zippers is illustrated. In its simplest form, the slide assembly (10) includes a slide member (12) and a pull member (14). The slide assembly (10) is preferably formed during a single operation in a die cast machine (not shown). The slide member (12) is formed to include a bridge (16) for locating and retaining the pull member (14) in a manner that allows for rotation and some linear translation of the pull member (14). The bridge (16) is also formed so that it does not include breaks or gaps which could weaken the bridge (16) and allow the pull member (14) to be released. Particularly, the bridge (16) includes a first end (18) and a second end (20) and central portion (22). Both the first and second ends (18) (20) are integrally formed to the top surface (24) of the slide (12). An inner surface (26) of the bridge is formed to be substantially flat as it extends transversely from side to side of the slide, but may include any desirable longitudinal contour for function or aesthetics. Because the bridge is integrally formed, corner radii (28) and fillets (30) may be formed during the die casting process to add strength and rigidity to the structure as well as aesthetic appearance. The inner portion (32) of the slide (12) includes a splitter (34) which divides the inner portion (32) into a Y-shape for causing the zipper chain (not shown) to be joined or separated as is known in the art. In a preferred embodiment, the slide (12) includes an upper guide (72) and a lower guide (74) for guiding the zipper chain through the slide (12), the upper guide (72) and the lower guide (74) being separated and secured together with a splitter (34), the splitter and said guides (72) (74) are constructed and arranged to interlock the zipper chain when moved in a first direction and disengage the zipper chain when moved in a second direction. At least one, and in some embodiments two guide wall(s) (36) are integrally formed as part of the slider to help guide the teeth as they pass through the slider assembly (12).

The pull (14) is formed in position around the bridge (16) to include a loop portion (38). The loop portion (38) is integrally formed to the first tab portion (40) to eliminate breakage and separation of the two components during use. The loop portion (38) may include any geometry desirable, which may include rounds, ovals, polygons and the like, so long as the geometry is complete and does not require converging flat surfaces that are required to remove the tools from the formed part during manufacturing as seen in the prior art. In the embodiment illustrated in FIG. 1, the loop portion (38) is formed to be square in cross section, having a substantially flat inner loop surface (42) with inner corners (44) providing the desired appearance and function to the overall slide assembly (10). FIG. 2 illustrates a slide assembly (10) having a loop portion (38) with a round cross section formed around the same or similar bridge construction as described in FIG. 1. In this embodiment, the loop geometry is formed complete and does not require relief geometry for the tooling retraction after forming.

FIG. 3 illustrates one embodiment for forming the pull (14) in place around the bridge (16). As illustrated, the tool includes at least one side shifting slide (46). As the die casting tool (50) is closed to form a slide (12) and pull (14), the at least one side shifting slide (46) and at least one first insert (48) and one secondary insert (52) are inserted into the area under the bridge (16). The insert (48) and side shifting slide (46) are positioned first along an insertion path so that the side shift can occur after the slide has reached its insertion depth. Next, the secondary insert (52) is timed to be positioned in the mold adjacent to the side shift slide (46) once the side shift has occurred. The remaining portions of the mold can be closed before, after, or simultaneously with the slides without departing from the scope of the invention. Other portions of the mold include mold sections that form the remainder of the loop (38) and pull (14). In a most preferred embodiment, the pull (14) is positioned to stand vertically with respect to the slide as illustrated in FIG. 1. However, it should be noted that by utilizing the side shifting slide(s), the pull may be rotated to different angles as needed in the mold without departing from the scope of the invention. After formation of the slider assembly (10) in the die cast mold, the at least one side shifting slide (46) is configured to make an orthogonal side shift after formation of the slide member assembly, the side shift having a length great enough to clear the geometry of the loop portion (38) before retraction of the slide from under the bridge (16).

Referring to FIGS. 4-8, a slide assembly (10) further including a connecting link (54) positioned and formed between the pull member (14) and the slide member (12) is illustrated. The connecting link (54) is formed as a continuous member, extending around the bridge (16) and the loop (38) connecting the bridge (16) to the pull member (14). The connecting link (54) is formed using the side shifting slides (46) in the same manner as the loop portion (38) of the pull (14).

Referring to FIGS. 5-8, a slide assembly (10) having a pull member (14) molded on each respective side of the slider assembly is illustrated. In this embodiment, the slide member (12) includes a bottom surface (25), the bottom surface includes a second bridge (56), the second bridge (56) having a first end (58) and a second end (60), both integrally formed to the bottom surface (25). An inner surface (26) of the bridge is formed to be substantially flat as it extends transversely across the inner surface (62). The second pull member (64) includes a second loop portion (68) and a second tab portion (70). The second loop portion (68) is formed as a continuous loop around the second bridge (56) and integrally formed to the second tab portion (70). In this embodiment, the slide member (12) and said pull members (14) (64) are formed in a single operation in a die casting tool (50); the die casting tool having at least one side shifting slide (46) for forming a portion of each of the inner surfaces (26) (62) of the first and second bridges (16) (56) and a lower portion of each loop portion (38) (68) of the pull members (14) (64), each at least one side shifting slide (46) being configured to shift orthogonally with respect to its insertion path.

Figure 9:
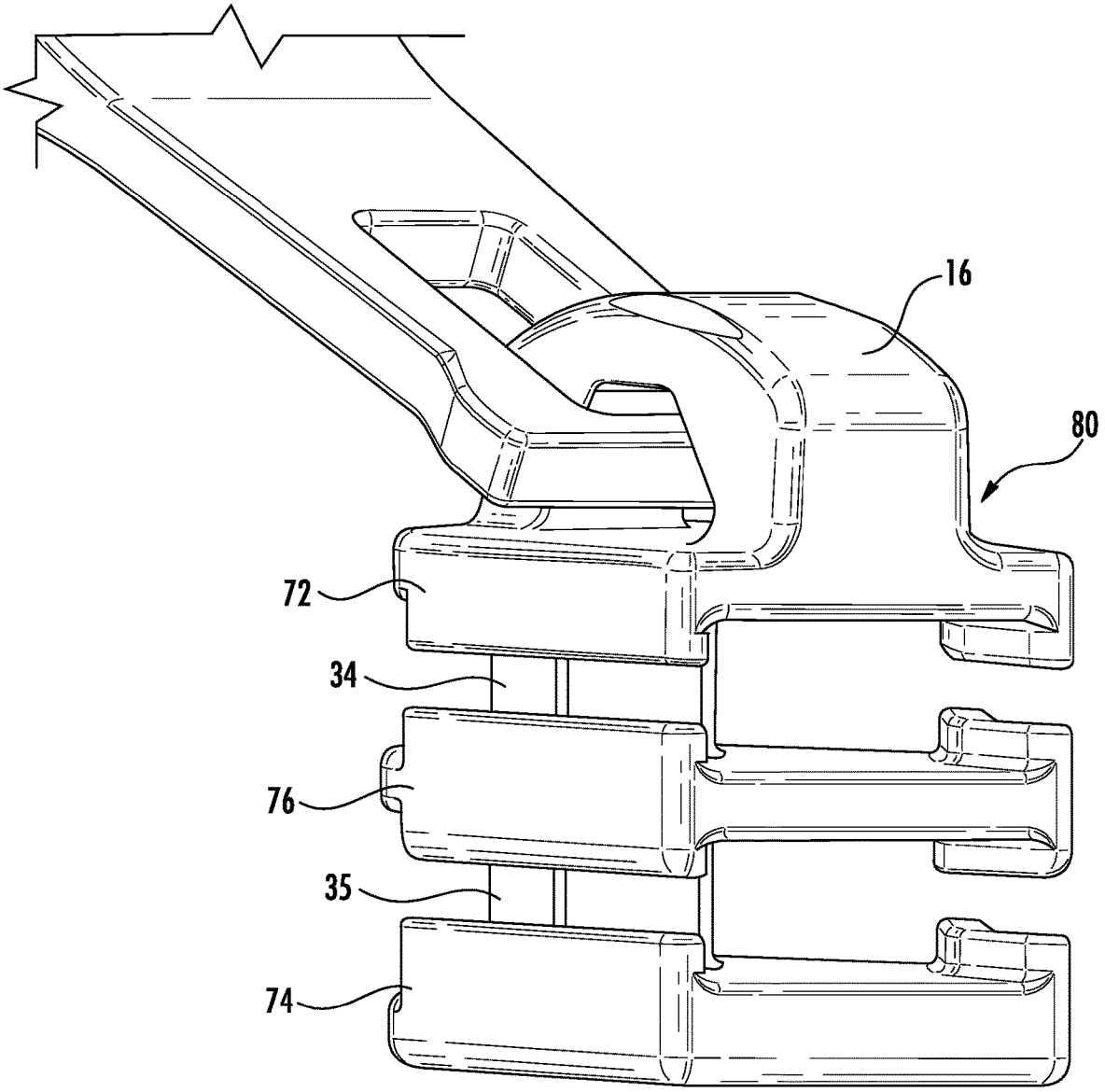
FIG. 9 is an isometric view illustrating a slide assembly useful for double zippers.

Referring to FIG. 9, a double chain slider assembly (80) is illustrated. In this embodiment, the slide (12) includes an upper guide (72), a middle guide (76) and a lower guide (74) for guiding a first zipper chain (not shown) and a second zipper chain (not shown) through the slide (12). The upper guide (72) and the middle guide (76) are separated and secured together with a first splitter (34), while the middle guide (76) and the lower guide (74) are separated and secured together with a second splitter (35). The splitters (34) (35) and the guides (72) (76) (74) are constructed and arranged to interlock a first zipper chain and a second zipper chain (not shown) when moved in a first direction, and disengage the first zipper chain and the second zipper chain when moved in a second direction. This embodiment may be used for zipper chains that are the same or different from the first to the second zipper chain. This embodiment applies to waterproof zipper chains and the like, wherein one zipper chain provides fastening while the second zipper chain provides water proofing.

Referring to FIGS. 1-9, it should be noted that the pulls or slides may include indicia (78), in the form of logos, figures, characters or the like that are integrally formed as part of the slider assembly. This also includes, but should not be limited to, serial numbers, lot numbers, part numbers, patent numbers, trademarks and the like. It should also be noted that the present embodiments are specifically utilized for forming slider assemblies from metal in a die casting process, and thus various metals may be utilized, including, but not limited to, zinc, aluminum, magnesium, titanium, copper, brass, and suitable combinations thereof.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention, and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A double chain slider assembly (80) for a zipper comprising:

a metal slide member (12), said slide member (12) includes an upper guide (72), and a middle guide (76) separated and secured together with a first splitter (34) for guiding a first zipper chain, said slide member (12) further including a second splitter (35) separating and securing a lower guide (74) to the middle guide (76) for guiding a second zipper chain, said slide member (12) including a top surface (24), said top surface (24) including a bridge (16) formed as a continuous member having a first end (18) and a second end (20) integrally formed to the top surface (24), an inner surface (26) of the bridge (16) defining an opening between the bridge (16) and the top surface (24); a pull member (14) formed from metal with the slider member (12) during a single operation, the pull member (14) having a loop portion (38) and a first tab portion (40), said loop portion (38) formed as a continuous loop around the bridge (16) and integrally formed to the first tab portion (40); wherein the upper guide (72), the first splitter (34) and the middle guide (76) are constructed and arranged to interlock a first zipper chain when moved in a first direction, and disengage the first zipper chain when moved in a second direction, and wherein the middle guide (76), the second splitter (35) and the lower guide (74) are constructed and arranged to interlock a second zipper chain when moved in the first direction and disengage the second zipper chain when moved in the second direction.

2. The double chain slider assembly (80) for a zipper of claim 1 wherein the slider includes guide walls (36) integrally formed as part of the slider member (12) to guide the teeth of the zipper chain as they pass through the upper guide (72), the middle guide (76) and the lower guide (74).

3. The double chain slider assembly (80) for a zipper of claim 1 wherein the first tab portion (40) of the pull member (14) includes an aperture extending through the tab portion (40), the aperture positioned at an opposite end of the tab portion (40) with respect to the loop portion (38).

4. The double chain slider assembly (80) for a zipper of claim 1 wherein the first tab portion (40) of the pull member (14) includes an aperture extending through the tab portion (40), the aperture positioned at a center portion of the first tab portion (40) with respect to the pull member (14).

5. The double chain slider assembly (80) for a zipper of claim 1 wherein an inner surface (26) of said bridge (16) formed to be substantially flat as it extends transversely across said inner surface (26).

6. The slide assembly for a zipper of claim 1 wherein said loop portion (38) of said pull member (14) is substantially round.

7. The slide assembly for a zipper of claim 1 wherein said loop portion (38) of said pull member (14) is substantially square.

8. The slide assembly for a zipper of claim 1 wherein said loop portion (38) of said pull member (14) is polygon shaped.

9. The slide assembly of claim 1 wherein said pull member (14) includes indicia (78) formed integrally thereon.

10. The slide assembly of claim 1 wherein said slide member (12) includes indicia (78) formed integrally thereon, said indicia (78) formed during said die casting process.

11. The slide assembly of claim 1 wherein said slide assembly (10) is die cast.

12. The slide assembly of claim 9 wherein said metal is selected from the group consisting of zinc, aluminum, magnesium, titanium, copper, brass and combinations thereof.

* * * * *